US005692231A

United States Patent [19]

O et al.

[11] Patent Number: 5,692,231

[45] Date of Patent: Nov. 25, 1997

[54] IMAGE FORMING SYSTEM FOR ENABLING DETECTION OF THE QUANTITY OF SHEETS REMAINING IN A SHEET CASSETTE

[75] Inventors: Gown-Jong O, Suwon; Won-Hyun Song, Goyang; In-Soo Lee, Seoul, all of Rep. of Korea

[73] Assignee: SamSung Electronics Co. Ltd., Kyungki-do, Rep. of Korea

[21] Appl. No.: 685,566

[22] Filed: Jul. 24, 1996

[30] Foreign Application Priority Data

Jul. 24, 1995 [KR] Rep. of Korea ..... 21892/1995
May 16, 1996 [KR] Rep. of Korea ..... 163771996

[51] Int. Cl.[6] ..... G03G 21/00

[52] U.S. Cl. ..... 399/23; 399/393

[58] Field of Search ..... 399/23, 393; 248/542; 269/11; 362/98, 99, 5

[56] References Cited

FOREIGN PATENT DOCUMENTS

| | | |
|---|---|---|
| 53-80908 | 7/1978 | Japan . |
| 58-75164 | 5/1983 | Japan . |
| 58-144035 | 8/1983 | Japan . |
| 4-243744 | 8/1992 | Japan . |
| 6-247589 | 9/1994 | Japan . |

*Primary Examiner*—Nestor R. Ramirez
*Attorney, Agent, or Firm*—Robert E. Bushnell, Esq.

[57] ABSTRACT

An image forming system includes a sheet cassette installed within an insertion hole formed in a main body of the image forming system. The sheet cassette stores sheets of a printable medium that are operated upon by the image forming system. A window is formed along an outer surface of the sheet cassette to enable a user to visually detect a quantity of the sheets remaining within the sheet cassette without having to remove the sheet cassette from the insertion hole.

24 Claims, 9 Drawing Sheets

IMAGE FORMING SYSTEM FOR ENABLING DETECTION OF THE QUANTITY OF SHEETS REMAINING IN A SHEET CASSETTE

CROSS-REFERENCE TO RELATED APPLICATIONS

This application makes reference to, incorporates the same herein, and claims all benefits accruing under 35 U.S.C. §119 from applications for Image Forming System For Enabling Detection Of The Quantity Of Sheets Remaining In A Sheet Cassette earlier filed in the Korean Industrial Property Office on 24 Jul. 1995 and 16 May 1996 and there duly assigned Ser. Nos. 21892/1995 and 16377/1996, respectively.

BACKGROUND OF THE INVENTION

The present invention relates to an image forming system, such as a laser beam printer, copy machine, facsimile, etc., and more particularly, to an image forming system for enabling a user to detect the quantity of sheets remaining in a sheet cassette installed within a main body of the system, without having to remove the sheet cassette from the system.

In today's modern society, image forming systems, such as laser beam printers, copy machines, facsimiles, etc., are widely available. In these image forming systems, sheets of a printable medium, such as paper, are stored within one or more sheet cassettes. When the image forming system is operated to generate a desired number of prints, the user often wants to have information regarding the number of sheets remaining within the sheet cassette. Conventionally, the user must manually withdrawal the sheet cassette from the image forming system to visually detect the quantity of sheets remaining within the cassette. This technique, however, is often inconvenient for the user since it requires the user to stop his or her current activity and manually withdrawal the sheet cassette from the image forming system.

One prior art reference that enables a user to visually detect the remaining quantity of sheets available for image forming operations is U.S. Pat. No. 4,860,055 entitled Image Forming Apparatus Capable Of Displaying Capacity And/Or Remaining Quantity of Sheets Of Paper issued to Ohira et at. In Ohira et al. '055, an image forming system is provided with a device that contains sheets of paper and includes a transparent cover. Accordingly, a user can visually detect the quantity of sheets that remain within the device. While this type of conventional art does provide advantages in its own right, we note that the device containing the sheets in Ohira et al. '055 extends from the main body of the image forming system, rather than being installed within the main body. As a result, the image forming system disclosed in Ohira et al. '055 occupies a substantial amount of space.

SUMMARY OF THE INVENTION

Therefore, it is an object of the present invention to provide an improved image forming system for enabling detection of the quantity of sheets remaining in a sheet cassette installed within the image forming system.

It is another object to provide an image forming system that enables detection of the quantity of sheets remaining in a sheet cassette installed within the image forming system, and concurrently reduces the mount of space occupied by the image forming system.

It is still another object to provide an image forming system for enabling detection of the quantity of sheets remaining in a sheet cassette installed within the image forming system, without having to remove the sheet cassette from the body of the image forming system.

It is yet another object to provide an image forming system for enabling detection of the quantity of sheets remaining in a sheet cassette installed within the image forming system, even in a dark environment.

It is still yet another object to provide an image forming system for enabling detection of the quantity of sheets remaining in a sheet cassette installed within the image forming system that can be manufactured in a reduced time and for a reduced cost.

It is a further object to provide an image forming system for enabling detection of the quantity of sheets remaining in a sheet cassette installed within the image forming system, wherein a user can visually detect a reduction in the number of sheets remaining in the sheet cassette during a series of image forming operations.

To achieve these and other objects, the present invention provides an image forming system having a sheet cassette installed within an insertion hole formed in a front portion of a main body of the image forming system. The sheet cassette stores sheets of a printable medium that are operated upon by the image forming system. A window is formed along an outer surface of the sheet cassette to enable a user to visually detect a quantity of the sheets remaining within the sheet cassette without having to remove the sheet cassette from the insertion hole.

According to another aspect of the present invention a method can be performed for detecting a quantity of sheets remaining in a sheet cassette of an image forming system. The method contemplates the steps of: placing the sheets into the sheet cassette; inserting the sheet cassette into a cavity formed within a body of the image forming system so that the sheet cassette is at least substantially contained by the body; performing a series of image forming operations to generate visible images upon ones of the sheets; and detecting the quantity of the sheets remaining in the sheet cassette without removing the sheet cassette from the cavity by viewing a window formed along an outer surface of the sheet cassette.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Figure 1:
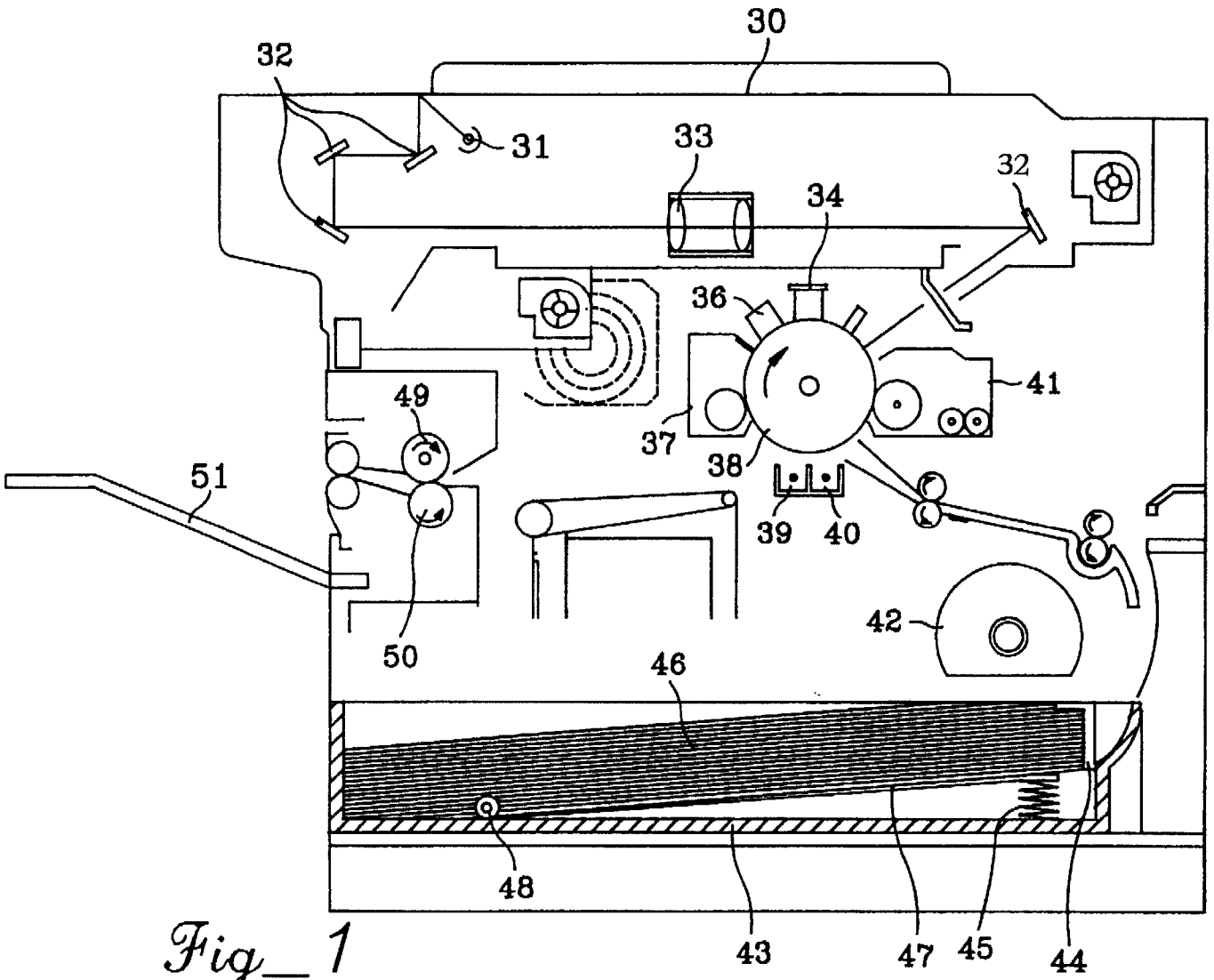
FIG. 1 schematically depicts a general image forming system in which a sheet cassette is installed.

Turning now to the drawings and referring to FIG. 1, a general image forming system in which a sheet cassette is installed is shown. The image forming system of FIG. 1 performs a general electrostatic image forming process as follows. When an image formation start signal is input to the system, the outer surface of a photoconductive drum 38 is uniformly charged by a charger 34. In the case of a laser printer, the uniformly charged surface of the rotating photoconductive drum 38 is sequentially scanned with a laser beam produced from a light-exposure lamp 31 of a laser scanner unit so that a latent image corresponding to an image is formed on the photoconductive drum 38. In the case of a copy machine, the photoconductive drum 38 is scanned with light reflected from a document placed on a document stand 30 by the light-exposure lamp 31. The electrostatic latent image corresponding to the document's image whose magnification is set by four mirrors 32 and a lens unit 33 is formed on the photoconductive drum 38. The electrostatic latent image is transformed into a visible toner image by a developer unit 41. A transfer unit 40 transfers the toner image from photoconductive drum 38 to a sheet 46 that is fed from a sheet cassette 43 by a pick-up roller 42. The sheet 46 comes into close contact with the photoconductive drum 38 from an electrostatic force, and is separated from the surface of the photoconductive drum 38 by a separating unit 39. After the sheet 46 is separated from the drum 38, it is passed between a heating roller 49 and a compression roller 50, and the toner image is fused to the sheet 46 by heat and pressure. The sheet 46 is then expelled from the system and deposited into a tray 51. Residual toner and the latent image that remain on the surface of the drum 38 are removed by a cleaning unit 37 and an image removing lamp 36, respectively.

A sheet feeding system for the image forming system of FIG. 1 includes the sheet cassette 43 that stores the sheets 46 of paper or other printable medium, and the pick-up roller 42 and conveyor rollers for conveying the sheets 46. The sheet feeding system serves to feed the sheets 46 loaded on a sheet feed plate 47 of the sheet cassette 43 in serial order. Sheet feed plate 47 pivots upwardly and downwardly about a hinge 48 formed on the bottom of sheet cassette 43, and a spring 45 is disposed under sheet feed plate 47 to feed the sheets 46 to pick-up roller 42. Fingers 44 are formed on both inner sidewalls of sheet cassette 43 to prevent separation of the sheets 46 from sheet cassette 43, and to further prevent double sheet feeding. In the image forming system of FIG. 1, a user is unable to detect the number of stacked sheets 46 within sheet cassette 43 without physically removing the sheet cassette 43 from the body of the image forming system.

Figure 2:
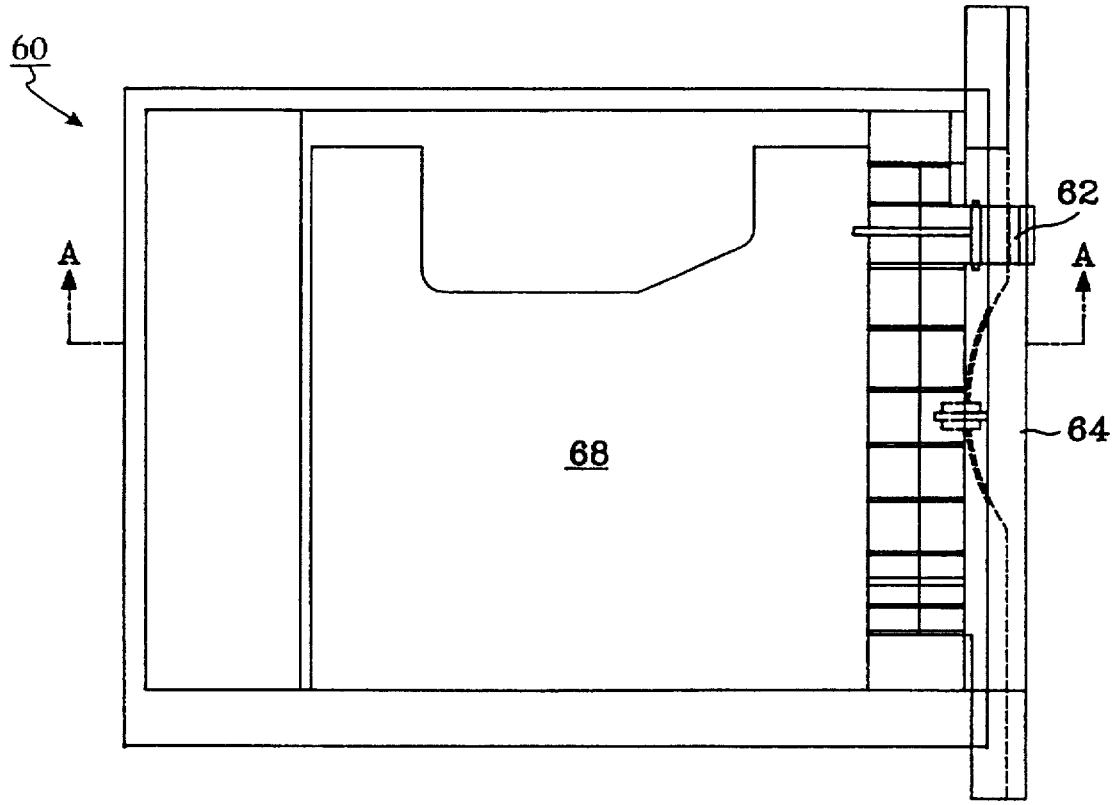
FIG. 2 depicts a plan view of a conventional sheet cassette.
Figure 3:
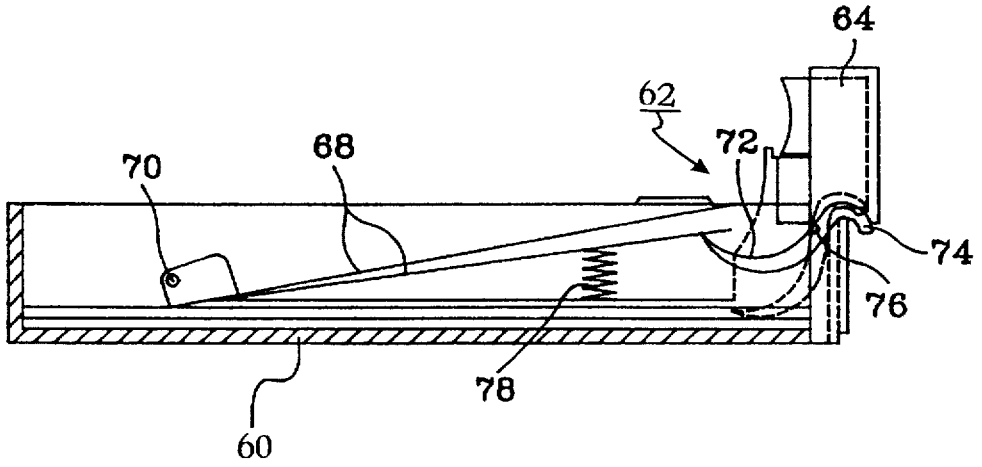
FIG. 3 depicts a sectional view taken along line A—A of FIG. 2.

Referring to FIGS. 2 and 3, plan and sectional views of a conventional sheet cassette are shown. Sheet cassette 60 of FIGS. 2 and 3 is inserted into a cassette insertion opening formed in the lower section of an image forming system, and is engaged with an engaging recess (not shown) formed on the main body of the image forming system. A sheet plate 68 pivots upwardly and downwardly about a hinge 70 formed on the bottom of sheet cassette 60, and a spring 78 is disposed under the sheet plate 68 to smoothly feed the sheets of paper to a pick-up roller.

FIG. 3 depicts the sheet plate 68 when no sheets, 50 sheets, and 250 sheets are installed within sheet cassette 60. An upper panel 64 extends upwardly on the front side of sheet cassette 60 and protrudes in a forward direction, and an indicator unit 62 having an arm 72 and a boss 74 is coupled to upper panel 64's lower portion by a hinge 76 to move upwardly and downwardly.

Figure 4:
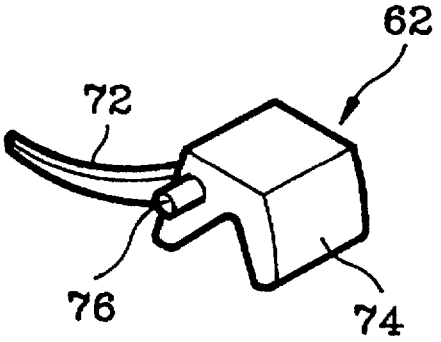
FIG. 4 depicts a perspective view of an indicator unit of FIG. 3.

Referring now to FIG. 4, the indicator unit 62 is shown in detail. Arm 72 is designed to be curvilinear, and an outermost end of arm 72 comes into close contact with the bottom of sheet plate 68. Boss 74 is designed to have the shape of a circular arc on its lower portion. Boss 74 is heavier than the arm 72, and can be moved upwardly and downwardly.

When 250 sheets of paper are stacked on sheet plate 68, indicator unit 62 is moved upwardly and pushed into the front panel 64 as sheet plate 68 simultaneously pivots downwardly about hinge 70. When 50 sheets of paper are stacked on the sheet plate 68, indicator unit 62 is moved downwardly as sheet plate 68 simultaneously pivots upwardly, and an end portion of boss 74 is moved away from panel 64. When there are no sheets on sheet plate 68, sheet plate 68 maintains its original state from the force of spring 78. Since the boss 74 is heavier than the arm 72, the boss 74 protrudes from the front panel 64 in this state. Accordingly, the indicator unit 62 enables a user to be aware of the presence of paper.

According to the configuration described above, the user can detect the presence of paper in sheet cassette 60 by whether the indicator unit 62 projects or not. This approach is limited, however, since it restricts the number of sheets that can be detected to 250, 50 and zero. Therefore, the user is not provided with an accurate means to determine the number of remaining sheets. As a result, the user does not know exactly when he should re-fill the sheet cassette 60 with paper, and he must take into account the relationship between the weight of the arm 72 and boss 74 with respect to the elastic force of the spring 78. Moreover, he must install the indicator unit 62 into the image forming system, thereby beating the additional expense.

Preferred embodiments of the present invention are now described in detail with reference to the accompanying drawings.

The present invention employs various sheet feeding systems. These sheet feeding systems are disclosed on pp. 333–347 of *Electrophotographic Technology* published in 1988 by Corona Co. Ltd., Japan. In addition to those systems, cassette-type sheet feeding systems can also be applied to the present invention.

The following description concerns a first preferred embodiment in which the inventive device is applied to one of the most popular systems.

Figure 5:
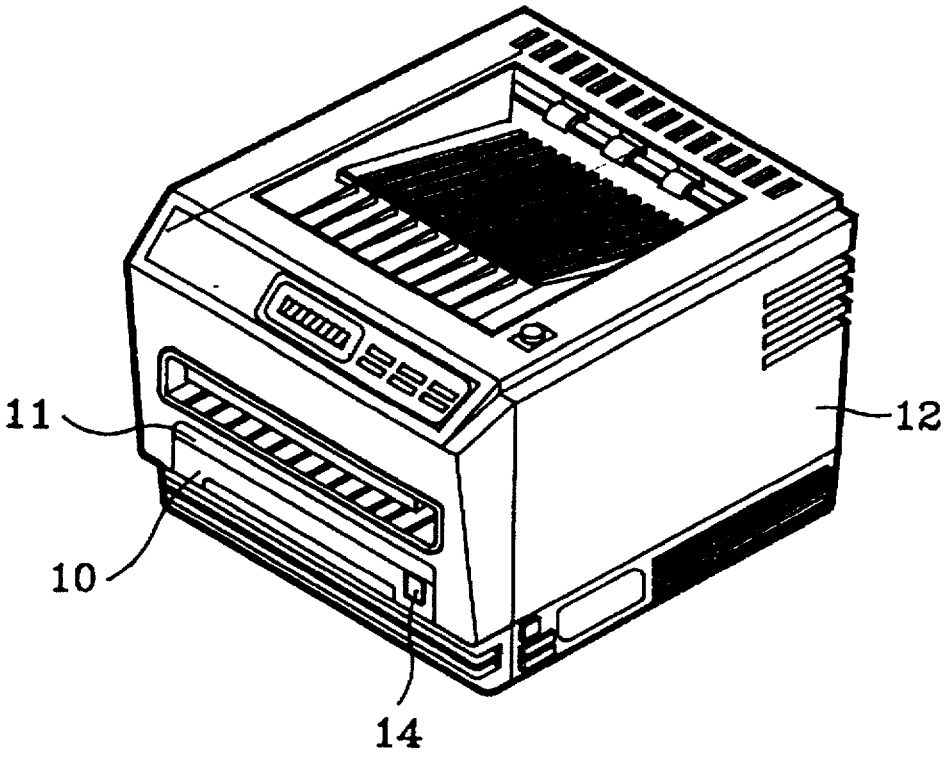
FIG. 5 depicts a perspective view of an image forming system in which a sheet cassette is installed in accordance with the principles of the present invention.

Referring to FIGS. 5 through 8, the first preferred embodiment of the present invention will be described. In FIG. 5, the leading end of a sheet cassette 10 is inserted into a cassette insertion opening 11 formed in the lower front face of a main body 12 of an electrophotographic processing system. A window 14 is formed on one side of the outer housing of sheet cassette 10 so that a user can readily detect the presence of sheets within the sheet cassette 10 without removing sheet cassette 10 from the main body 12.

Figure 6:
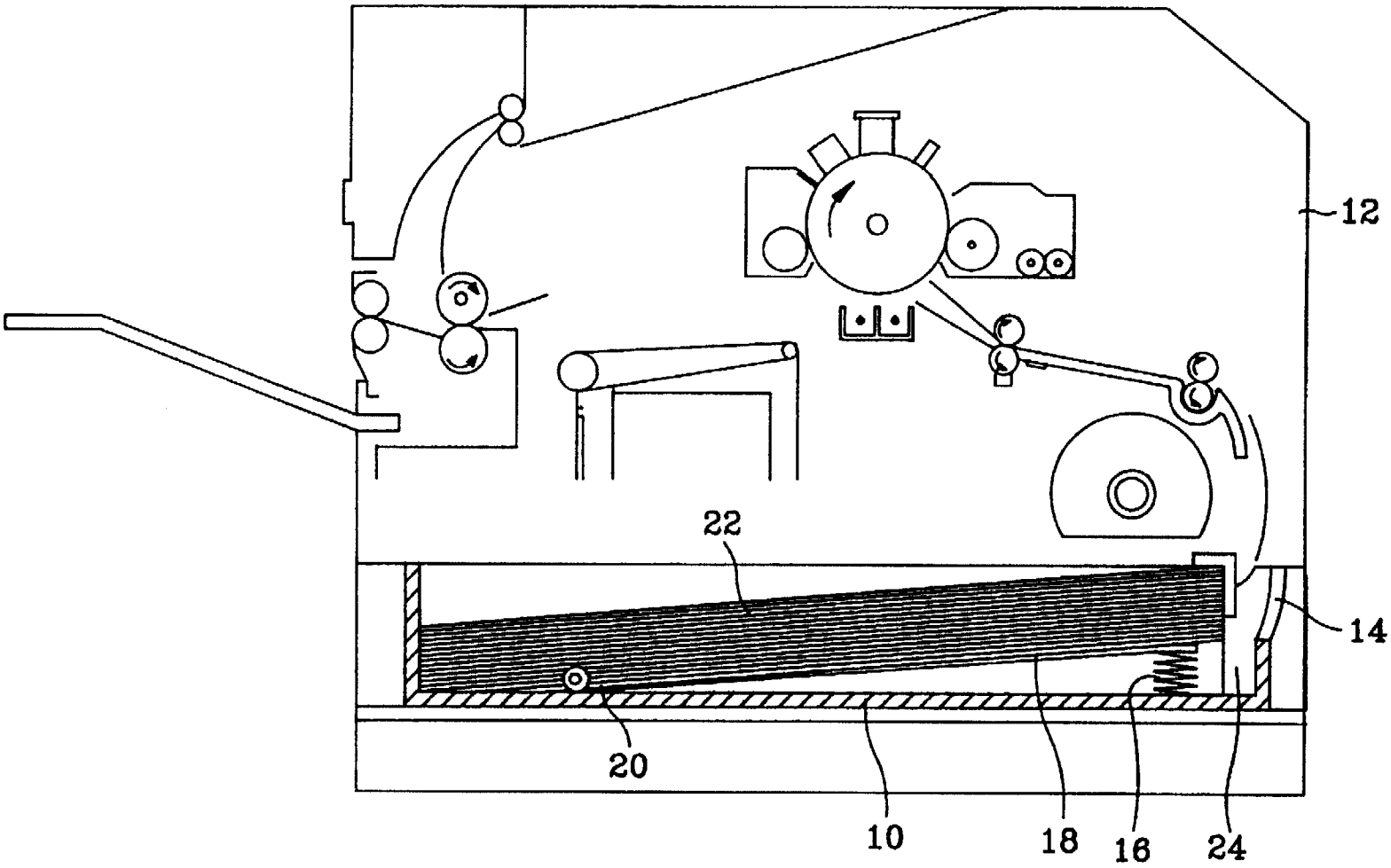
FIG. 6 schematically depicts a sectional view of an image forming system in which a sheet cassette is installed in accordance with the principles of the present invention.
Figure 7:
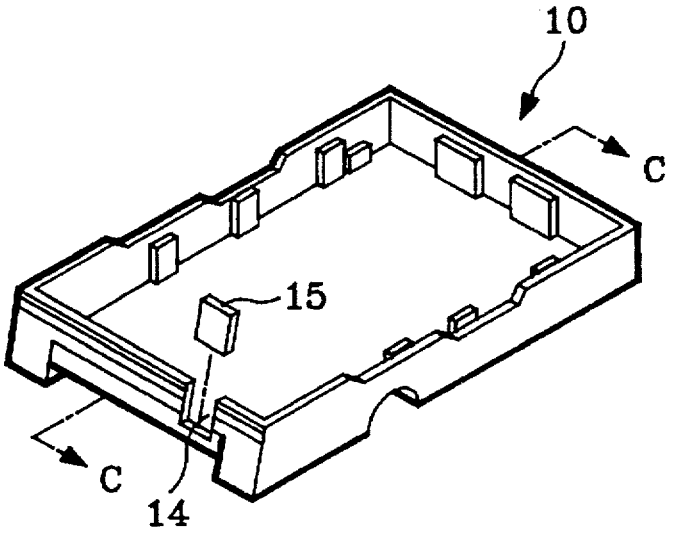
FIG. 7 depicts a perspective view of a sheet cassette that enables a user to detect the number of sheets of paper remaining within the sheet cassette in accordance with a first preferred embodiment of the present invention.
Figure 8:
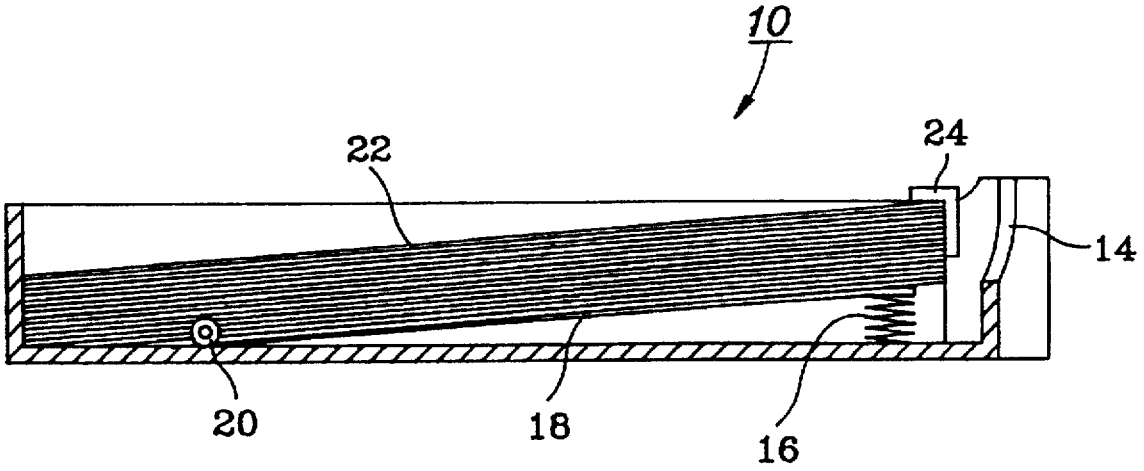
FIG. 8 depicts a sectional view taken along line C—C of FIG. 7.

As shown in FIGS. 6 and 8, a sheet plate 18 on which sheets 22 of paper or another printable medium are stacked is connected by a hinge 20 on the inner bottom surface of sheet cassette 10, and pivots upwardly and downwardly about hinge 20 according to the weight of the sheets 22. A spring 16 is disposed under sheet plate 18 to smoothly feed sheets of paper 22 to the pick-up roller. Fingers 24 are formed on both inner sidewalls of sheet cassette 10 to prevent separation of the sheets 22 from the sheet cassette 10, and to further prevent double sheet feeding. Window 14, which is formed on one side of the outer housing of sheet cassette 10, may have a transparent cover 15, as shown in FIG. 7, made from either acrylic resin or cellophane to prevent dirt and dust from entering the sheet cassette 10.

The following description relates to the operation and effect of the first preferred embodiment of the present invention. The printing operation of the electrophotographic processing system is performed as described previously in conjunction with FIG. 1.

When the sheets 22 are stacked on sheet plate 18 and the sheet cassette 10 is inserted into the cassette insertion opening 11, the spring 16 disposed under sheet plate 18 is in a compressed state due to the weight of the stacked sheets 22. Note that when there are no sheets 22 of paper on sheet plate 18, spring 16 is not compressed and therefore exhibits its original shape. Since sheet plate 18 pivots downwardly about the hinge 20 from the weight of the stacked sheets 22, a user can readily observe the height of the stacked sheets 22 through the window 14, and can accordingly detect how many sheets 22 are remaining within sheet cassette 10.

As the electrophotographic processing system performs printing operations over a given period of time, the quantity of sheets 22 stored in sheet cassette 10 gradually decreases, and the spring 16 whose elastic force becomes larger than the force exerted by the weight of the stacked sheets 22 begins to assume its original shape. As the sheet plate 18 pivots upwardly about hinge 20, the user can visually observe the reduction in the quantity of sheets 22 within sheet cassette 10 through window 14.

The inventive sheet feeding system of the first preferred embodiment of the present invention allows a user to detect the presence of sheets 22 through the window 14 formed on the outer surface of sheet cassette 10, not through an indicator unit. Moreover, the remaining quantity of sheets 22 can be detected without having to remove the sheet cassette 10 from the main body 12 of the electrophotographic processing system. Since the present invention does not require an indicator unit, it possesses the advantage of having a simplified structure. Therefore, manufacture time and production costs are reduced.

A second preferred embodiment of the present invention will now be described with reference to FIGS. 5, 7, 8 and 9. In FIG. 5, the leading end of a sheet cassette 10 is inserted into a cassette insertion opening 11 formed in the lower front face of a main body 12 of an electrophotographic processing system. A window 14 is formed on one side of the outer housing of sheet cassette 10 so that a user can readily detect the presence of sheets within the sheet cassette 10 without removing sheet cassette 10 from the main body 12.

Figure 9:
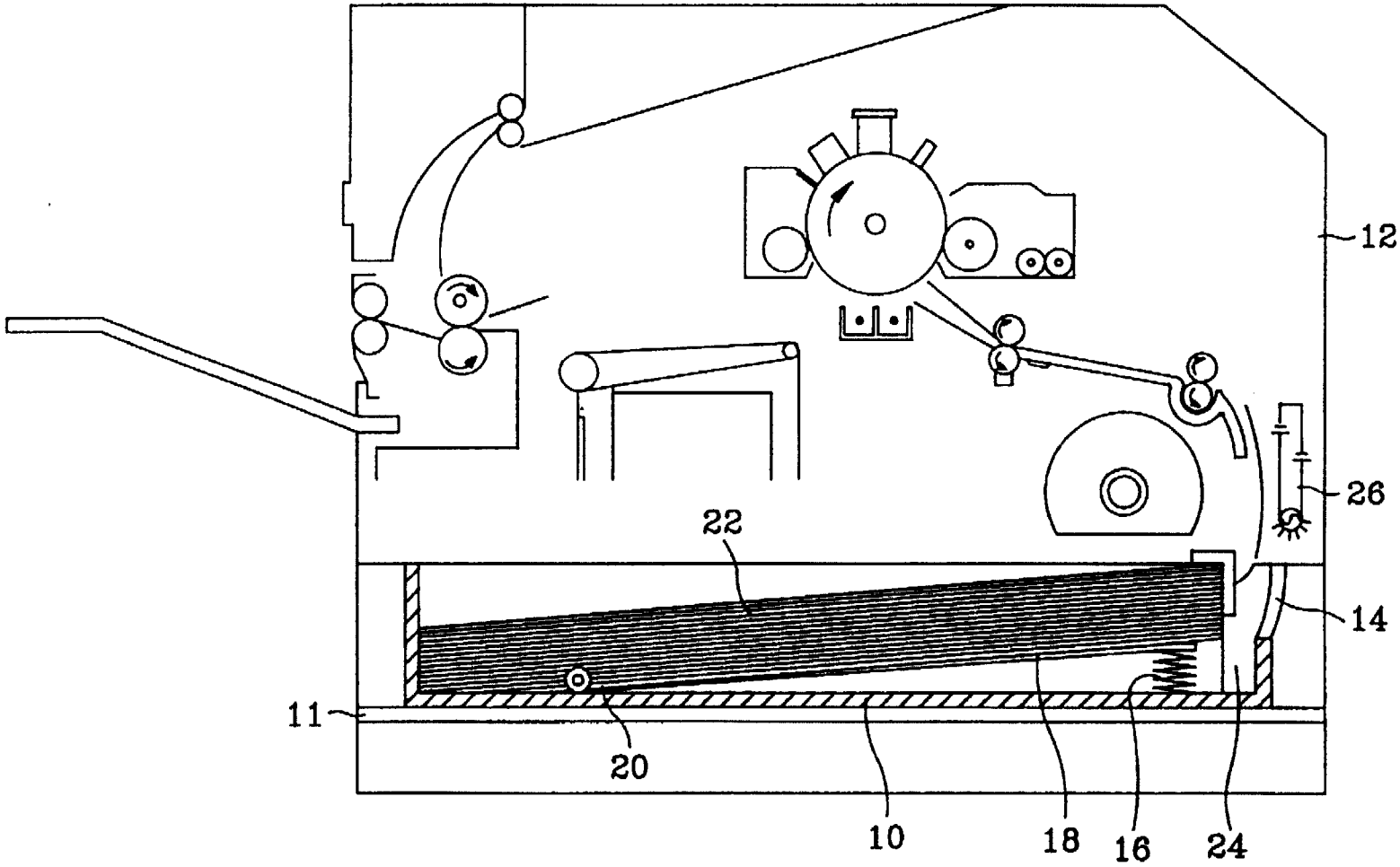
FIG. 9 schematically depicts a sectional view of an image forming system in which a sheet cassette and a light-emitting device are installed in accordance with a second preferred embodiment of the present invention.

As shown in FIGS. 8 and 9, a sheet plate 18 on which sheets 22 of paper or another printable medium are stacked is connected by a hinge 20 on the inner bottom surface of sheet cassette 10, and pivots upwardly and downwardly about hinge 20 according to the weight of the sheets 22. A spring 16 is disposed under sheet plate 18 to smoothly feed sheets of paper 22 to the pick-up roller. Fingers 24 are formed on both inner sidewalls of sheet cassette 10 to prevent separation of the sheets 22 from the sheet cassette 10, and to further prevent double sheet feeding. Window 14, which is formed on one side of the outer housing of sheet cassette 10, may have a transparent cover 15, as shown in FIG. 7, made from either acrylic resin or cellophane. A light emitting device 26 is installed within the cassette insertion opening 11 adjacent to window 14 so that a user can visually observe the remaining quantity of sheets 22 within sheet cassette 10 through window 14, even in a dark environment. The light emitting device 26 can be a light bulb or a light emitting diode, and is turned on and off by a control device (not shown) formed on the upper section of main body 12.

The following description relates to the operation and effect of the second preferred embodiment of the present invention. The printing operation of the electrophotographic processing system is performed as described previously in conjunction with FIG. 1.

When the sheets 22 are stacked on sheet plate 18 and the sheet cassette 10 is inserted into the cassette insertion opening 11, the spring 16 disposed under sheet plate 18 is in a compressed state due to the weight of the stacked sheets 22. Note that when there are no sheets 22 of paper on sheet plate 18, spring 16 is not compressed and therefore exhibits its original shape. Since sheet plate 18 pivots downwardly about the hinge 20 from the weight of the stacked sheets 22, a user can readily observe the height of the stacked sheets 22 through the window 14, and can accordingly detect how many sheets 22 are remaining within sheet cassette 10. If the electrophotographic processing system is located in a dark environment, the user can manipulate the control device formed on the upper section of main body 12 to turn on light emitting device 26, and therefore enhance visibility.

As the electrophotographic processing system performs printing operations over a given period of time, the quantity of sheets 22 stored in sheet cassette 10 gradually decreases, and the spring 16 whose elastic force becomes larger than the force exerted by the weight of the stacked sheets 22 begins to assume its original shape. As the sheet plate 18 pivots upwardly about hinge 20, the user can visually observe the reduction in the quantity of sheets 22 within sheet cassette 10 through window 14. In this second preferred embodiment, light emitting device 26 can be turned on or off depending on the amount of light that is present in the environment where the electrophotographic processing system is located.

The inventive sheet feeding system of the second preferred embodiment of the present invention allows a user to detect the presence of sheets 22 through the window 14 formed on the outer surface of sheet cassette 10, not through an indicator unit. Moreover, the remaining quantity of sheets 22 can be detected without having to remove the sheet cassette 10 from the main body 12 of the electrophotographic processing system. Since the present invention does not require an indicator unit, it possesses the advantage of having a simplified structure. Therefore, manufacture time and production costs are reduced. This second preferred embodiment is particularly advantageous since it provides effective operation in both light and dark environments.

Figure 10:
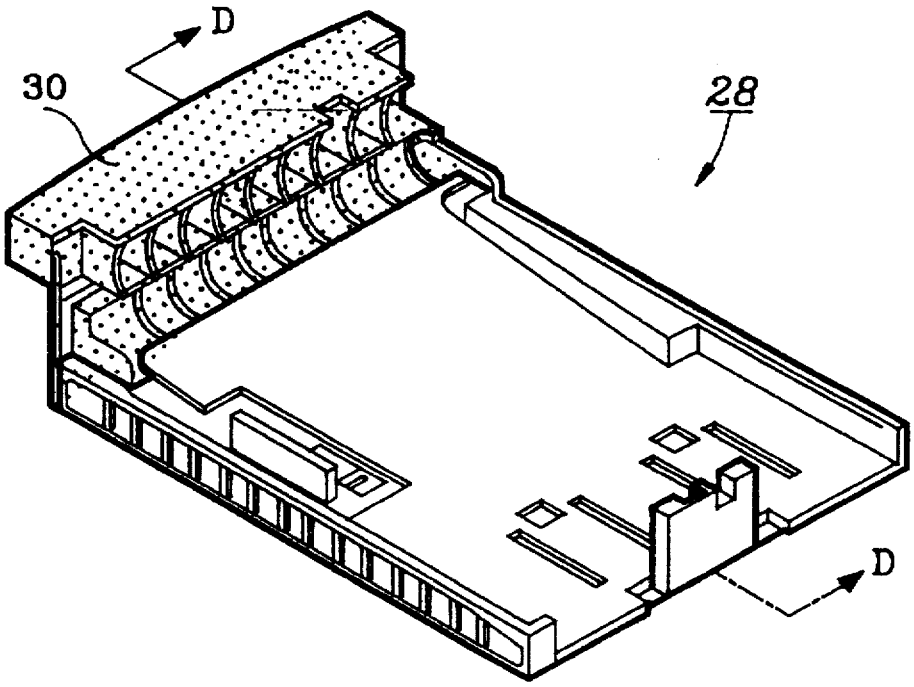
FIG. 10 depicts a perspective view of a sheet cassette that enables a user to detect the number of sheets of paper remaining within the sheet cassette in accordance with a third preferred embodiment of the present invention.

A third preferred embodiment of the present invention will now be described with reference to FIGS. 10 through 12. In FIG. 12, the leading end of a sheet cassette 28 is inserted into a cassette insertion opening 34 formed in the lower front face of a main body 32 of an electrophotographic processing system. A transparent window 30 is formed along the entire length of the outer surface of sheet cassette 28 so that a user can readily detect the presence of sheets within the sheet cassette 28 without removing sheet cassette 28 from the main body 32. Transparent window 30 is preferably constructed from a plastic material, and may be colored to provide an aesthetically desirable appearance.

Figure 11:
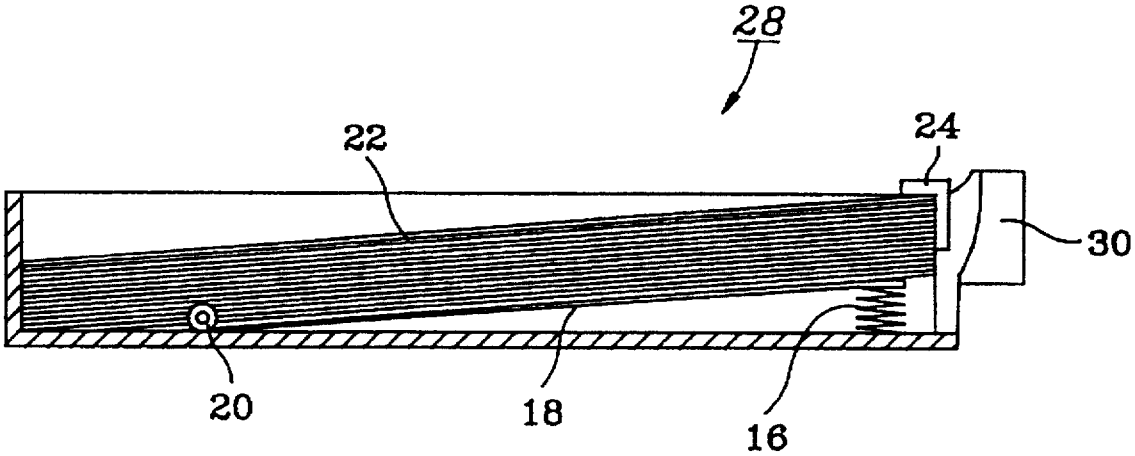
FIG. 11 depicts a sectional view taken along line D—D of FIG. 10.
Figure 12:
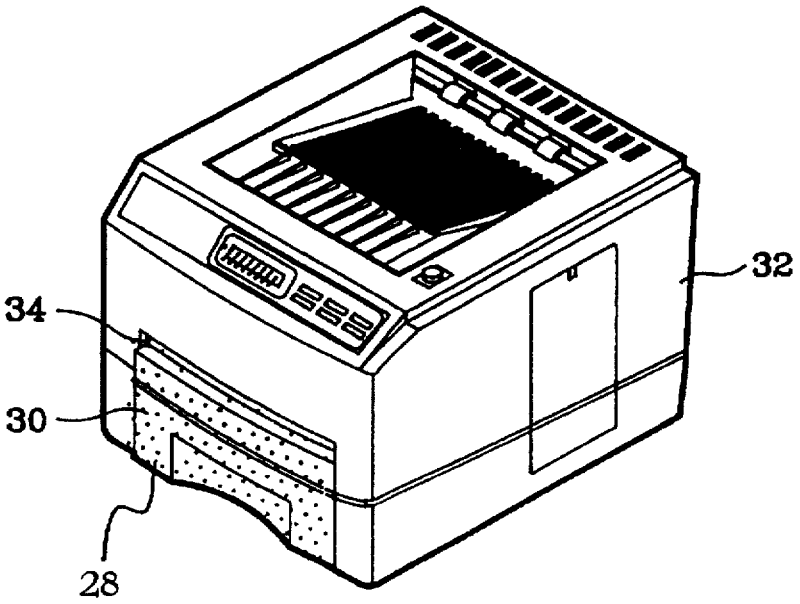
FIG. 12 depicts a perspective view of an image forming system in which a sheet cassette is installed in accordance with the third preferred embodiment of the present invention.

As shown in FIG. 11, a sheet plate 18 on which sheets 22 of paper or another printable medium are stacked is connected by a hinge 20 on the inner bottom surface of sheet cassette 28, and pivots upwardly and downwardly about hinge 20 according to the weight of the sheets 22. A spring 16 is disposed under sheet plate 18 to smoothly feed sheets of paper 22 to the pick-up roller. Fingers 24 are formed on both inner sidewalls of sheet cassette 28 to prevent separation of the sheets 22 from the sheet cassette 28, and to further prevent double sheet feeding.

The following description relates to the operation and effect of the third preferred embodiment of the present invention. The printing operation of the electrophotographic processing system 15 performed as described previously in conjunction with FIG. 1.

When the sheets 22 are stacked on sheet plate 18 and the sheet cassette 28 is inserted into the cassette insertion opening 34, the spring 16 disposed under sheet plate 18 is in a compressed state due to the weight of the stacked sheets 22. Note that when there are no sheets 22 of paper on sheet plate 18, spring 16 is not compressed and therefore exhibits its original shape. Since sheet plate 18 pivots downwardly about the hinge 20 from the weight of the stacked sheets 22, a user can readily observe the height of the stacked sheets 22 through the transparent window 30, and can accordingly detect how many sheets 22 are remaining within sheet cassette 28.

As the electrophotographic processing system performs printing operations over a given period of time, the quantity of sheets 22 stored in sheet cassette 28 gradually decreases, and the spring 16 whose elastic force becomes larger than the force exerted by the weight of the stacked sheets 22 begins to assume its original shape. As the sheet plate 18 pivots upwardly about hinge 20, the user can visually observe the reduction in the quantity of sheets 22 within sheet cassette 28 through transparent window 30.

The inventive sheet feeding system of the third preferred embodiment of the present invention allows a user to detect the presence of sheets 22 through the transparent window 30 formed along the entire length of the outer surface of sheet cassette 28, not through an indicator unit. Moreover, the remaining quantity of sheets 22 can be detected without having to remove the sheet cassette 28 from the main body of the electrophotographic processing system. Since the present invention does not require an indicator unit, it possesses the advantage of having a simplified structure. Therefore, manufacture time and production costs are reduced.

Figure 13:
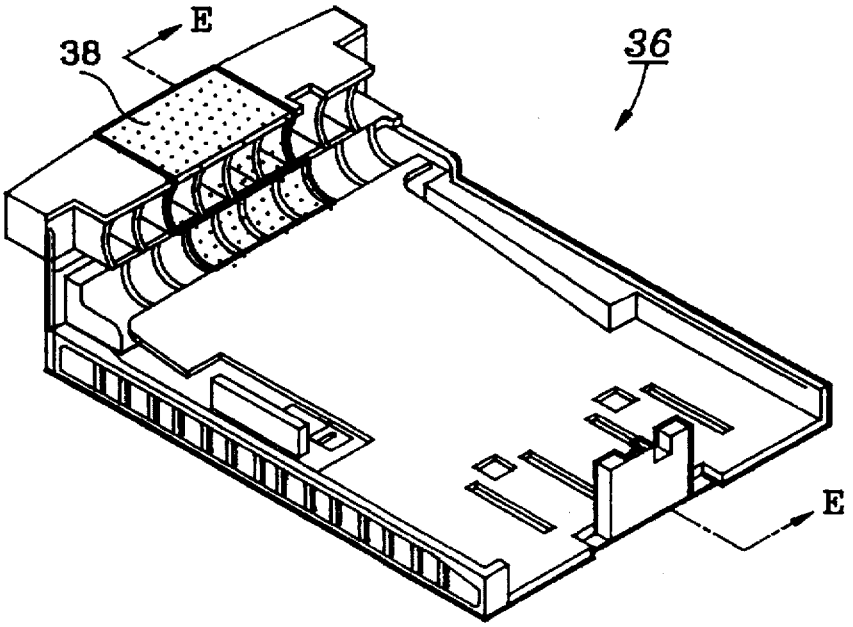
FIG. 13 depicts a perspective view of a sheet cassette that enables a user to detect the number of sheets of paper remaining within the sheet cassette in accordance with a fourth preferred embodiment of the present invention.

A fourth preferred embodiment of the present invention will now be described with reference to FIGS. 13 through 15. In FIG. 15, the leading end of a sheet cassette 36 is inserted into a cassette insertion opening 42 formed in the lower front face of a main body 40 of an electrophotographic processing system. A transparent window 38 is formed along a partial length of the outer surface of sheet cassette 36 so that a user can readily detect the presence of sheets within the sheet cassette 36 without removing sheet cassette 36 from the main body 40. In particular, transparent window 38 is formed symmetrically with a central horizontal axis of sheet cassette 36. Transparent window 38 is preferably constructed from a plastic material, and may be colored to provide an aesthetically desirable appearance. Sheet cassette 36 also includes a sheet number indicator 44 having numerically designated notches on one side of transparent window 38 to provide the user with a means by which to precisely detect the number of sheets remaining within the sheet cassette 36.

Figure 14:
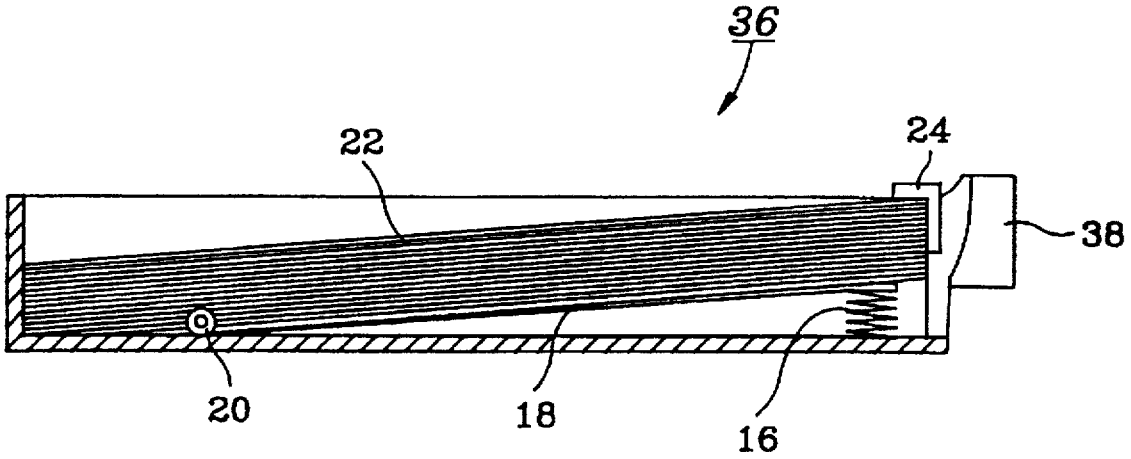
FIG. 14 depicts a sectional view taken along line E—E of FIG. 13.
Figure 15:
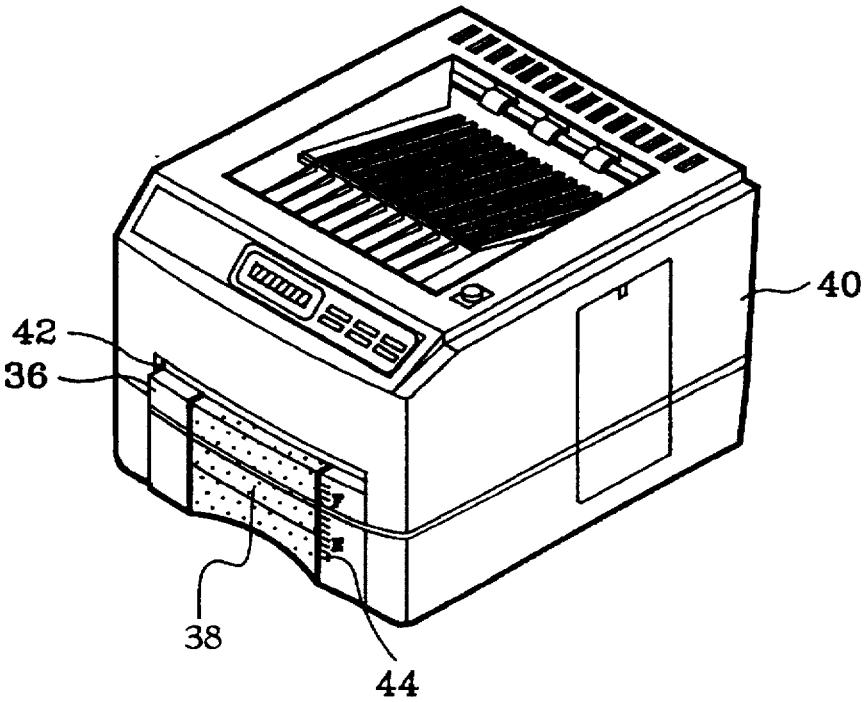
FIG. 15 depicts a perspective view of an image forming system in which a sheet cassette is installed in accordance with the fourth preferred embodiment of the present invention.

As shown in FIG. 14, a sheet plate 18 on which sheets 22 of paper or another printable medium are stacked is connected by a hinge 20 on the inner bottom surface of sheet cassette 36, and pivots upwardly and downwardly about hinge 20 according to the weight of the sheets 22. A spring 16 is disposed under sheet plate 18 to smoothly feed sheets of paper 22 to the pick-up roller. Fingers 24 are formed on both inner sidewalls of sheet cassette 36 to prevent separation of the sheets 22 from the sheet cassette 36, and to further prevent double sheet feeding.

The following description relates to the operation and effect of the fourth preferred embodiment of the present invention. The printing operation of the electrophotographic processing system is performed as described previously in conjunction with FIG. 1.

When the sheets 22 are stacked on sheet plate 18 and the sheet cassette 36 is inserted into the cassette insertion opening 42, the spring 16 disposed under sheet plate 18 is in a compressed state due to the weight of the stacked sheets 22. Note that when there are no sheets 22 of paper on sheet plate 18, spring 16 is not compressed and therefore exhibits its original shape. Since sheet plate 18 pivots downwardly about the hinge 20 from the weight of the stacked sheets 22, a user can readily observe the height of the stacked sheets 22 through the transparent window 38, and can accordingly detect how many sheets 22 are remaining within sheet cassette 36 via sheet number indicator 44.

As the electrophotographic processing system performs printing operations over a given period of time, the quantity of sheets 22 stored in sheet cassette 36 gradually decreases, and the spring 16 whose elastic force becomes larger than the force exerted by the weight of the stacked sheets 22 begins to assume its original shape. As the sheet plate 18 pivots upwardly about hinge 20, the user can visually observe the reduction in the quantity of sheets 22 within sheet cassette 36 through transparent window 38 and sheet number indicator 44.

The inventive sheet feeding system of the fourth preferred embodiment of the present invention allows a user to detect the presence of sheets 22 through the transparent window 38 formed along the central outer surface of sheet cassette 36 and sheet number indicator 44, not through a conventional indicator unit. Moreover, the remaining quantity of sheets 22 can be detected without having to remove the sheet cassette 36 from the main body 40 of the electrophotographic processing system. Since the present invention does not require a conventional indicator unit, it possesses the advantage of having a simplified structure. Therefore, manufacture time and production costs are reduced.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An image forming system, comprising:

a sheet cassette installed within an insertion portion formed in a front face of a main body of said image forming system, and storing sheets of a printable medium that are operated upon by said image forming system;

a window formed along an outer surface of said sheet cassette to enable a user to visually detect a quantity of said sheets remaining within said sheet cassette without having to remove said sheet cassette from said insertion portion; and light-emitting means positioned adjacent to said window to enable the user to visually detect the quantity of said sheets remaining within said sheet cassette in a dark environment.

2. The image forming system as claimed in claim 1, further comprising a transparent cover for covering said window to prevent dirt and dust from entering said sheet cassette.

3. The image forming system as claimed in claim 2, wherein said light-emitting means can be turned on and turned off selectively by the user.

4. The image forming system as claimed in claim 3, wherein said light-emitting means comprise one of a light bulb and a light-emitting diode.

5. The image forming system as claimed in claim 1, wherein said light-emitting means can be turned on and turned off selectively by the user.

6. The image forming system as claimed in claim 5, wherein said light-emitting means comprises a light bulb.

7. The image forming system as claimed in claim 5, wherein said light-emitting means comprises a light-emitting diode.

8. The image forming system as claimed in claim 1, further comprised of said window being formed along an entire length of said outer surface of said sheet cassette.

9. The image forming system as claimed in claim 1, further comprised of said window being formed along a partial length of said outer surface of said sheet cassette.

10. The image forming system as claimed in claim 9, further comprising a sheet number indicator formed adjacent to said window on said outer surface of said sheet cassette to provide numerical designations that enable the user to detect the quantity of said sheets remaining within said sheet cassette.

11. An image forming system, comprising:

a photoconductive dram for forming an electrostatic latent image;

a developing unit for applying developing material to said electrostatic latent image formed on said photoconductive drum to produce a toner image;

a sheet cassette installed within an insertion hole formed in a front portion of a main body of said image forming system, and storing sheets of a printable medium that receive the toner image from said photoconductive drum;

a window formed along an outer surface of said sheet cassette to enable a user to visually detect a quantity of said sheets remaining within said sheet cassette without having to remove said sheet cassette from said insertion hole; and light-emitting means positioned adjacent to said window to enable the user to visually detect the quantity of said sheets remaining within said sheet cassette in a dark environment.

12. The image forming system as claimed in claim 11, further comprising a transparent cover for covering said window to prevent dirt and dust from entering said sheet cassette.

13. The image forming system as claimed in claim 12, wherein said light-emitting means can be turned on and turned off selectively by the user.

14. The image forming system as claimed in claim 13, wherein said light-emitting means, comprises a light bulb.

15. The image forming system as claimed in claim 13, wherein said light-emitting means comprises a light-emitting diode.

16. The image forming system as claimed in claim 11, wherein said light-emitting means can be turned on and turned off selectively by the user.

17. The image forming system as claimed in claim 11, further comprised of said window being formed along an entire length of said outer surface of said sheet cassette.

18. The image forming system as claimed in claim 11, further comprised of said window being formed along a partial length of said outer surface of said sheet cassette.

19. The image forming system as claimed in claim 18, further comprising a sheet number indicator formed adjacent to said window on said outer surface of said sheet cassette to provide numerical designations that enable the user to detect the quantity of said sheets remaining within said sheet cassette.

20. A method for detecting a quantity of sheets remaining in a sheet cassette of an image forming system, comprising the steps of:

placing said sheets into said sheet cassette;

inserting said sheet cassette into a cavity formed within a main body of said image forming system so that said sheet cassette is at least substantially contained by said main body;

performing a series of image forming operations to generate visible images upon ones of said sheets; and detecting the quantity of said sheets remaining in said sheet cassette without removing said sheet cassette from said cavity by activating a light-emitting source positioned adjacent to a window formed along an outer surface of said sheet cassette and viewing said window.

21. An image forming system, comprising:

a photoconductive drum for forming an electrostatic latent image;

a developing unit for applying developing material to said electrostatic latent image formed on said photoconductive drum to produce a toner image;

a sheet cassette installed within a main body of said image forming system for storing sheets of a printable medium that receive the toner image from said photoconductive drum, said sheet cassette comprising:

a sheet plate having a first end pivotally connected to a bottom surface of said sheet cassette and a second end positioned opposite to said first end, said sheets being placed upon said sheet plate;

a spring installed between said bottom surface of said sheet cassette and said second end of said sheet plate for biasing said second end in a first direction; and a window formed along an outer surface of said sheet cassette to enable a user to visually detect a quantity of said sheets remaining within said sheet cassette without having to remove said sheet cassette from said main body.; and light-emitting means positioned adjacent to said window to enable the user to visually detect the quantity of said sheets remaining within said sheet cassette in a dark environment.

22. The image forming system as claimed in claim 21, wherein said light-emitting means can be turned on and turned off selectively by the user.

23. The image forming system as claimed in claim 21, wherein said light-emitting means comprises a light bulb.

24. The image forming system as claimed in claim 21, wherein said light-emitting means comprises a light-emitting diode.

* * * * *